US008267340B2

(12) United States Patent
Makino

(10) Patent No.: US 8,267,340 B2
(45) Date of Patent: Sep. 18, 2012

(54) AIRFLOW PULVERIZATION AND CLASSIFICATION DEVICE, AND PULVERIZATION METHOD

(75) Inventor: Nobuyasu Makino, Numazu (JP)

(73) Assignee: Ricoh Company Limited, Tokyo (JP)

( * ) Notice: Subject to any disclaimer, the term of this patent is extended or adjusted under 35 U.S.C. 154(b) by 163 days.

(21) Appl. No.: 12/649,768

(22) Filed: Dec. 30, 2009

(65) Prior Publication Data

US 2010/0170966 A1 Jul. 8, 2010

(30) Foreign Application Priority Data

Jan. 5, 2009 (JP) ..... 2009-000113

(51) Int. Cl.
*B02C 23/08* (2006.01)

(52) U.S. Cl. ..... 241/79.1; 241/101.2

(58) Field of Classification Search ..... 241/5, 39, 241/101.2, 79.1
See application file for complete search history.

(56) References Cited

U.S. PATENT DOCUMENTS

| | | | | |
|---|---|---|---|---|
| 3,688,991 | A * | 9/1972 | Andrews | 241/5 |
| 4,524,915 | A * | 6/1985 | Yamagishi | 241/39 |
| 4,592,302 | A * | 6/1986 | Motoyama et al. | 118/303 |
| 5,358,188 | A | 10/1994 | Makino et al. | |
| 5,577,670 | A | 11/1996 | Omata et al. | |
| 5,624,079 | A * | 4/1997 | Higuchi et al. | 241/39 |
| 5,765,766 | A * | 6/1998 | Yoshida et al. | 241/39 |
| 5,839,670 | A | 11/1998 | Omata et al. | |
| 5,938,045 | A | 8/1999 | Makino et al. | |
| 6,368,765 | B2 | 4/2002 | Izu et al. | |
| 6,503,681 | B2 | 1/2003 | Makino et al. | |
| 7,032,849 | B2 * | 4/2006 | Takahashi et al. | 241/39 |
| 7,156,331 | B2 * | 1/2007 | Takahashi et al. | 241/39 |
| 7,318,990 | B2 | 1/2008 | Makino et al. | |
| 7,364,101 | B2 | 4/2008 | Tanaka et al. | |
| 7,498,114 | B2 | 3/2009 | Makino et al. | |
| 2003/0178514 | A1 | 9/2003 | Makino et al. | |
| 2004/0211849 | A1 * | 10/2004 | Itoh et al. | 241/39 |
| 2005/0003294 | A1 | 1/2005 | Murakami et al. | |

(Continued)

FOREIGN PATENT DOCUMENTS

| | | |
|---|---|---|
| JP | 5-15801 | 1/1993 |

(Continued)

OTHER PUBLICATIONS

U.S. Appl. No. 12/600,345, filed Nov. 16, 2009, Nobuyasu Makino, et al.

*Primary Examiner* — Bena Miller
(74) *Attorney, Agent, or Firm* — Oblon, Spivak, McClelland, Maier & Neustadt, L.L.P.

(57) ABSTRACT

The airflow pulverization and classification device includes a pulverizer and a classifier. The pulverizer includes a pulverization chamber including a collision member; a jet nozzle directing jet flow toward the pulverization chamber; a feeder feeding a particulate material; a supply nozzle having an acceleration tube connected with the jet nozzle and the pulverization chamber, and a supply tube connected with the feeder and the acceleration tube to supply the particulate material the acceleration tube so that the particulate material is collided with the collision member; and a pressure gauge measuring a static pressure in the feeder and/or the supply tube, and/or a static pressure at the junction of the acceleration tube and the supply tube to control the supply conditions of the particulate material supplied to the acceleration tube on the basis of the measured static pressure.

18 Claims, 5 Drawing Sheets

U.S. PATENT DOCUMENTS

| | | | |
|---|---|---|---|
| 2006/0063091 | A1 | 3/2006 | Makino et al. |
| 2006/0214036 | A1 | 9/2006 | Makino |
| 2006/0222980 | A1 | 10/2006 | Makino et al. |
| 2007/0031754 | A1 | 2/2007 | Murakami et al. |
| 2008/0003518 | A1 | 1/2008 | Kubota et al. |
| 2008/0227022 | A1 | 9/2008 | Noge et al. |
| 2009/0159730 | A1 | 6/2009 | Makino et al. |
| 2009/0206008 | A1 | 8/2009 | Makino et al. |

FOREIGN PATENT DOCUMENTS

| | | |
|---|---|---|
| JP | 5-309288 | 11/1993 |
| JP | 7-136543 | 5/1995 |
| JP | 8-52376 | 2/1996 |
| JP | 8-299833 | 11/1996 |
| JP | 9-29127 | 2/1997 |
| JP | 9-206621 | 8/1997 |

* cited by examiner

AIRFLOW PULVERIZATION AND CLASSIFICATION DEVICE, AND PULVERIZATION METHOD

BACKGROUND OF THE INVENTION

1. Field of the Invention

The present invention relates to an airflow pulverization and classification device for forming a particulate material. In addition, the present invention also relates to a pulverization method.

2. Discussion of the Background

Toner is typically used for developing an electrostatic latent image in image forming methods such as electrophotography and electrostatic recording methods. In order to produce high quality images (such as high definition images), toner having a relatively small particle diameter is preferably used. Such a small toner can be prepared by a pulverization method having the following processes:

(1) Heating and kneading toner constituents such as binder resins and colorants (e.g., dyes, pigments and magnetic materials) to prepare a toner constituent mixture;

(2) Cooling the kneaded toner constituent mixture to solidify the toner constituent mixture; and (3) Pulverizing the solidified toner constituent mixture, followed by classification to prepare toner particles having a desired average particle diameter.

In the pulverization and classification process, an airflow pulverization and classification device including a pulverizer in which a toner constituent mixture is accelerated and collided with a collision plate by jet stream to be pulverized, and a classifier which works with the pulverizer and in which the pulverized particles are classified using swirling flow formed at an upper portion of the pulverizer. Specific examples of the pulverization/classification device include an impact dispersion separator (IDS from Nippon Pneumatic Mfg. Co., Ltd.), which is illustrated in FIG. 1.

The pulverization/classification device illustrated in FIG. 1 is mainly constituted of a classifier 7, a coarse particle receiving chamber 8 and a pulverizer 9. The operation of the classifier 7 is as follows. A powder to be classified, which is supplied from a hopper 1 of the classifier 7, is fed to an entrance 2*a*. The powder passing the entrance 2*a* is dispersed in a dispersion chamber 2. Specifically, the powder is swirled so as to form counter free vortex by secondary airflow 2*b* supplied from the outside into the dispersion chamber 2, thereby classifying the powder into relatively fine particles and relatively coarse particles utilizing difference of the centrifugal force and centripetal force applied to the particles of the powder. The fine particles, for which a further pulverization operation is not necessary, are fed so as to be subjected to the next process. In contrast, the coarse particles fall into the coarse particle receiving chamber 8 by their own weight, and the coarse particles then enter into the pulverizer 9 through a casing hopper 3 serving as a feeder. In the pulverizer 9, coarse particles 10 sucked from an entrance 4 are collided with a collision plate 6 in a pulverization chamber 11 by jet flow 13 supplied from a jet nozzle 12 by an airflow source 13*a* (such as compressors) after being accelerated by a pulverization nozzle 5. The thus pulverized coarse particles are fed again to the dispersion chamber 2 together with the powder supplied from the hopper 1. Thus, the powder is subjected to a closed circuit pulverization and classification operation. Referring to FIG. 1, numerals 14, 15 and 16 respectively denote an acceleration tube, a supply tube, and a junction between the acceleration tube 14 and the supply tube 15.

Recently, a need exists for color image forming apparatus which can produce high quality color images at a high speed. In order to fulfill the need, the toner used for such color image forming apparatus is required to have a low melting point and a small average particle diameter. When such a toner is prepared using an airflow pulverization and classification device, problems in that the pulverized toner particles are adhered to the parts and inside walls of the device; and the pulverized toner particles aggregate, resulting in formation of coarse particles tend to be caused. In conventional airflow pulverization and classification devices, the conditions of the pulverized particles in the closed circuit of the device cannot be recognized, and thereby problems in that the pulverized particles aggregate with time, resulting in formation of coarse particles; and the pulverization chamber is clogged with the aggregated particles tend to be caused. In this case, the pulverization and classification operation of the devices has to be stopped, resulting in deterioration of the manufacturing efficiency and the yield of the toner.

When an external force applying device such as air vibrators, knockers and bridge breakers is used for preventing occurrence of the toner adhesion and aggregation problems, other problems such that the working conditions are worsened due to the noise and vibration caused by the device; and the metal parts constituting the pulverization/classification device are cracked due to the impact and vibration of the external force applying device, resulting in breakage of the pulverization/classification device tend to be caused.

In attempting to solve the problems, various airflow pulverization/classification devices have been proposed. For example, published unexamined Japanese patent application No. (hereinafter referred to as JP-A) 05-309288, which corresponds to U.S. Pat. Nos. 5,577,670 and 5,839,670, discloses a fine powder production device, in which a high pressure gas jet nozzle is set so as to extend in the vertical direction in attempting to efficiently perform pulverization while preventing occurrence of the toner adhesion and aggregation problems, and preventing local abrasion of the parts of the device (such as collision member and acceleration tube) caused by collision of the particles.

JP-A 05-15801, which also corresponds to U.S. Pat. Nos. 5,577,670 and 5,839,670, discloses a fine powder production device in attempting to prevent occurrence of the toner adhesion and aggregation problems and to prevent local abrasion of the parts of the device (such as collision member and acceleration tube) caused by collision of the particles.

JP-A 08-299833 corresponding to U.S. Pat. No. 5,765,766 discloses a jet mill in which a raw material to be pulverized is collided with a collision plate without excessively decelerating the speed of the gas by preventing formation of shock wave on a downstream side from the entrance of the raw material to be pulverized to enhance the pulverizability of the mill.

JP-A 07-136543 discloses a pulverizer in which an injection portion of a supply tube for feeding a raw material to be pulverized is set so as to be relatively slanted in the direction toward the exit of the acceleration tube compared to the guide portion, through which the raw material is supplied, to smoothly feed the material in the acceleration tube while increasing the speed of the raw material fed in the acceleration tube, resulting in prevention of clogging of the supply tube with the raw material.

JP-A 09-29127 discloses a pulverizer in which a jet nozzle is set so as to extend in the vertical direction and a raw material to be pulverized is supplied to the jet nozzle so as not to be far apart from the center of the acceleration tube of the jet nozzle in attempting to improve the pulverization efficiency while miniaturizing the pulverizer.

JP-As 09-206621 and 08-52376 have disclosed collision type airflow pulverizers in which after a high pressure gas in the accelerating nozzle is supersonically accelerated, the speed of the gas is maintained in the nozzle to collide a raw material to be pulverized against a collision plate while dispersing the material, resulting in enhancement of the pulverization efficiency.

As mentioned above, a need exists for a pulverization/classification device which can stably perform pulverization without causing the problems in that the pulverizer is clogged with aggregated particles and particles adhered to the pulverizer.

SUMMARY OF THE INVENTION

As an aspect of the present invention, an airflow type pulverization/classification device is provided. The pulverization/classification device includes a pulverizer configured to pulverize a particulate raw material (hereinafter referred to as particulate material), and a classifier configured to classify the pulverized particulate material. The pulverizer includes at least a pulverization chamber including a collision member; a jet nozzle configured to direct jet flow toward the pulverization chamber; a feeder configured to feed the particulate material; and a supply nozzle having an acceleration tube connected with the jet nozzle at a first end thereof while connected with the pulverization chamber at a second end, and a supply tube connected with the feeder at a first end thereof while connected with the acceleration tube at a second end thereof to supply the particulate material to the acceleration tube so that the particulate material is collided with the collision member by the jet flow to be pulverized. The pulverizer further includes a pressure gauge configured to measure at least one of a static pressure in the feeder, a static pressure in the supply tube and a static pressure at a junction of the acceleration tube and the supply tube, wherein the supply conditions of the particulate material supplied to the acceleration tube are controlled on the basis of the measured static pressure.

As another aspect of the present invention, a method for pulverizing a particulate material is provided. The method includes:

jetting air in an acceleration tube against a collision member;

feeding the particulate material to the acceleration tube through a feeder and a supply tube to collide the particulate material with the collision member while measuring at least one of a static pressure in the feeder, a static pressure in the supply tube or a static pressure at a junction of the acceleration tube and the supply tube; and controlling supply conditions of the particulate material supplied to the acceleration tube on the basis of the measured static pressure.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
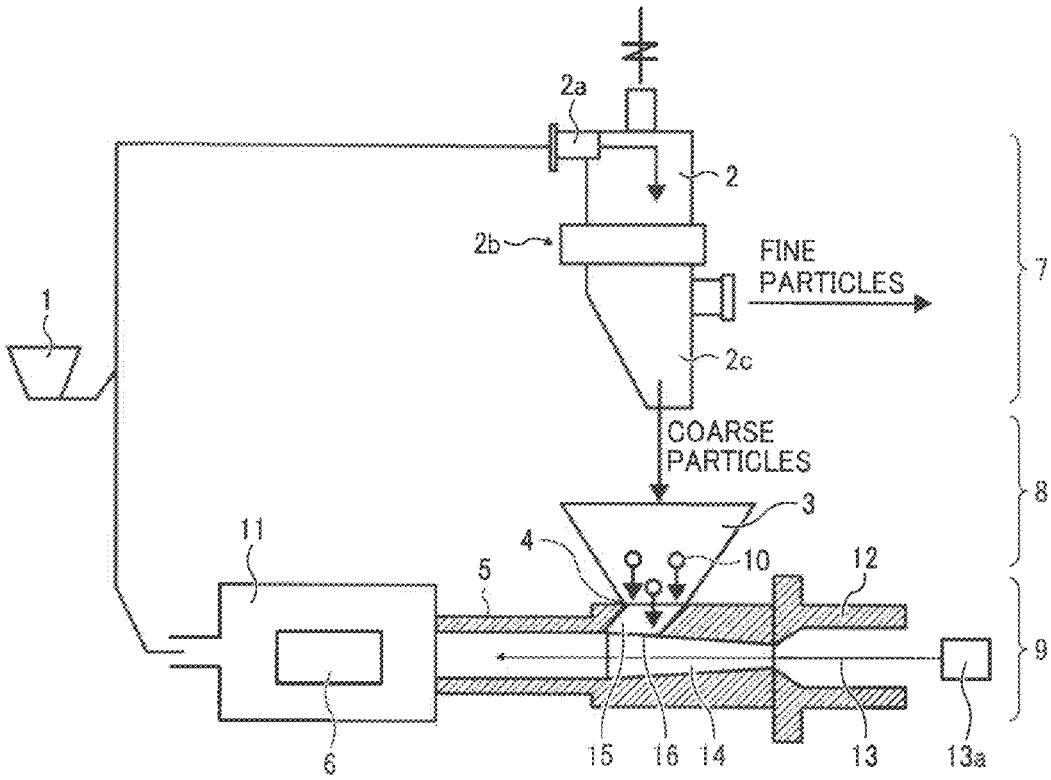
FIG. 1 BACKGROUND ART
FIG. 1 is a schematic view illustrating a background airflow pulverization/classification device.

In the present invention, an airflow type pulverization and classification device is provided. The pulverization/classification device includes a pulverizer configured to pulverize a particulate material, and a classifier configured to classify the pulverized particulate material. The pulverization/classification device includes a pulverizer configured to pulverize a particulate raw material (hereinafter referred to as particulate material), and a classifier configured to classify the pulverized particulate material. The pulverizer includes at least a pulverization chamber including a collision member; a jet nozzle configured to direct jet flow toward the pulverization chamber; a feeder configured to feed the particulate material; and a supply nozzle having an acceleration tube connected with the jet nozzle at a first end thereof while connected with the pulverization chamber at a second end, and a supply tube connected with the feeder at a first end thereof while connected with the acceleration tube at a second end thereof to supply the particulate material to the acceleration tube so that the particulate material is collided with the collision member by the jet flow to be pulverized. The pulverizer further includes a pressure gauge configured to measure at least one of a static pressure in the feeder, a static pressure in the supply tube and a static pressure at a junction of the acceleration tube and the supply tube, wherein the supply conditions of the particulate material supplied to the acceleration tube are controlled on the basis of the measured static pressure.

It is preferable that the pulverization/classification device includes a fluidized bed located above the junction of the acceleration tube and the supply tube to supply the particulate material to be pulverized to the acceleration tube while fluidizing the particulate material.

It is preferable that the amount of the particulate material supplied to the acceleration tube is controlled so that the static pressure falls in a range of from −3 kPa to −15 kPa.

In addition, it is preferable that a hopper is used as the feeder to supply the particulate material to be pulverized to first end of the supply tube, wherein the hopper includes a straight tube extending to the first end of the supply tube. The straight tube is preferably an adapter tube, which can be detachably attachable to the pulverizer and which can change the ratio (L/D) of the length (L) to the diameter (D) thereof.

Further, it is preferable that the particulate material to be pulverized has a weight average particle diameter of not greater than 10 μm.

Furthermore, it is preferable that the jet flow is formed by an airflow source at a pressure of from 0.4 to 0.7 MPa.

In the present application, a method for pulverizing a particulate material is also provided. The method includes:

jetting air in an acceleration tube against a collision member;

feeding the particulate material to the acceleration tube through a feeder and a supply tube to collide the particulate material with the collision member while measuring at least one of a static pressure in the feeder, a static pressure in the supply tube and a static pressure at a junction of the acceleration tube and the supply tube; and controlling supply conditions of the particulate material supplied to the acceleration tube on the basis of the measured static pressure.

Next, the airflow pulverization/classification device of the present invention will be explained in detail by reference to drawings.

Figure 2:
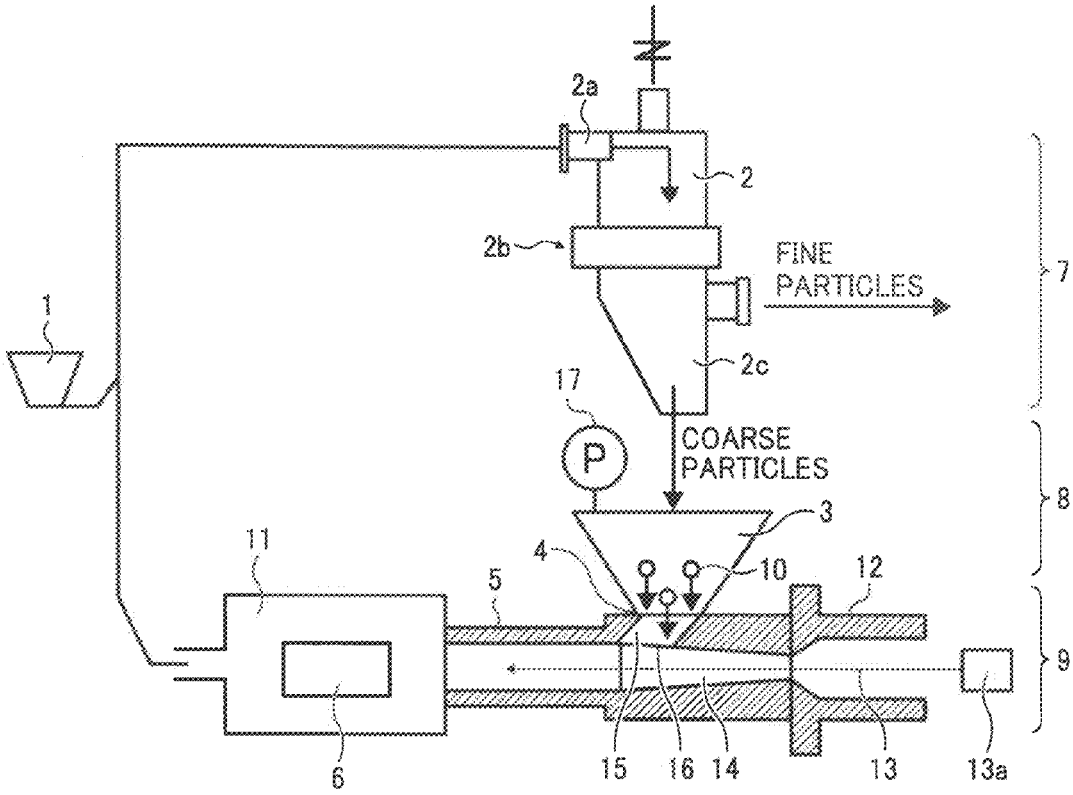
FIG. 2 is a schematic view illustrating an example of the airflow pulverization/classification device of the present invention.

FIG. 2 is a schematic view for explaining the airflow pulverization/classification device of the present invention. In FIGS. 1 and 2, like reference characters designate like corresponding parts, and detailed explanation of the parts mentioned above by reference to FIG. 1 is not made here.

Coarse particles obtained by the classification operation of the classifier 7 and moving to the casing hopper 3 serving as a feeder are sucked from the entrance 4 by the pulverizer 9. In this case, the suction pressure is measured as a suction static pressure. The pressure is measured with a pressure gauge (static pressure gauge) 17 provided on an upper portion of the casing hopper 3, i.e., on a portion above the junction 16 of the acceleration tube 14 and the supply tube 15. The technical idea such that a pressure gauge is provided on a portion above the junction of an acceleration tube and a supply tube to measure the suction pressure, and the effects of measuring the suction pressure have not yet been presented until now.

This technique of measuring the suction pressure can be applied to pulverization/classification devices having one pulverizer and one classifier, pulverization/classification systems having one pulverizer and plural classifiers, and multistage pulverization/classification systems including plural sets of a pulverizer and a classifier to recognize the pulverization conditions.

In the pulverization/classification device of the present invention, the suction pressure measured with the pressure gauge 17 is preferably controlled so as to range from −3 to −15 kPa, and more preferably from −7 to −13 kPa. In this regard, the suction pressure may be directly indicated by the scale on the pressure gauge 17, or a method in which the pressure data are converted to an electric signal to be displayed on an operational panel of the pulverization/classification device and/or to be recorded by a data logger. By using these methods, the pulverization conditions can be recognized in real time.

It is preferable that the jet flow 13 is formed by an airflow source 13*a* (such as compressors) at a pressure of from 0.4 MPa to 0.7 MPa.

Figure 3A:
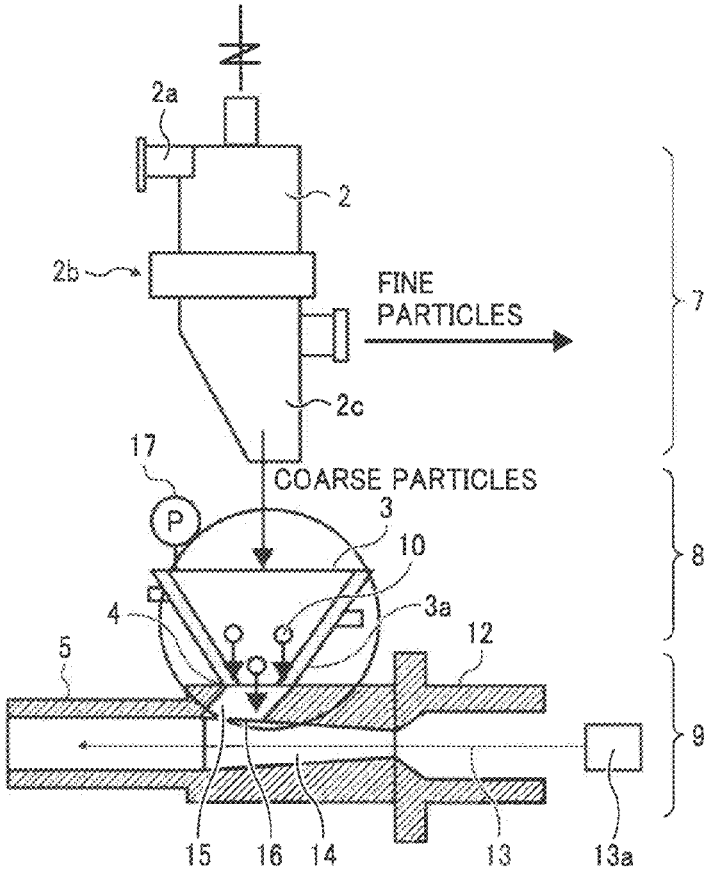
FIG. 3A is a schematic view illustrating another example of the airflow pulverization/classification device of the present invention.
Figure 3B:
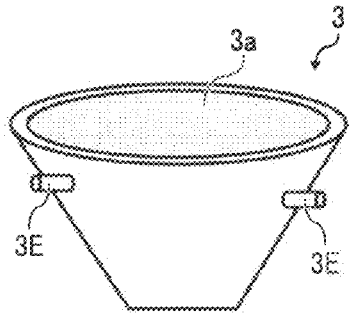
FIG. 3B is an enlarged view of a portion of the device illustrated in FIG. 3A.

FIG. 3A is a schematic view illustrating another example of the airflow pulverization/classification device of the present invention, which is the same as the device illustrated in FIG. 2 except that the casing hopper 3 has a fluidized bed. FIG. 3B is an enlarged view of the casing hopper 3 of the pulverization/classification device illustrated in FIG. 3A.

Referring to FIG. 3B, the inner surface of the casing hopper 3 has a double structure. Specifically, a sintered wire mesh 3*a* made of sintered metal wires and serving as a fluidized bed is provided above the inner wall of the casing hopper 3, thereby forming a space between the mesh and the inner wall. The mesh 3*a* has a structure such that plural different meshes are overlaid while united. The size of openings of the mesh 3*a* is not particularly limited, but is generally not greater than 3 μm, and preferably not greater than 2 μm. Referring to FIG. 3B, openings 3E are provided on the outer surface of the casing hopper 3 to spout air from the mesh 3*a* to fluidize the particles. The pressure of air supplied to the fluidized bed is preferably from 0.05 to 0.2 MPA so that a small amount of air is evenly spouted from the entire of the mesh 3*a*.

Figure 4A:
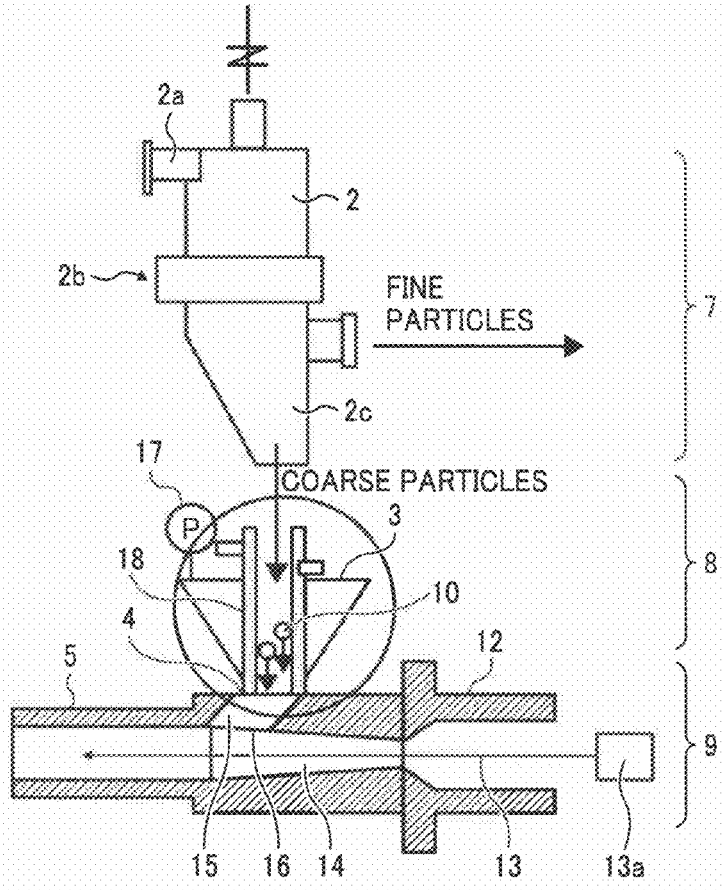
FIG. 4A is a schematic view illustrating yet another example of the airflow pulverization/classification device of the present invention.
Figure 4B:
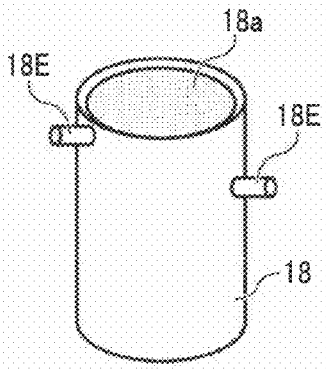
FIG. 4B is an enlarged view of a portion of the device illustrated in FIG. 4A.

FIG. 4A is a schematic view illustrating yet another example of the airflow pulverization/classification device of the present invention, which is the same as the device illustrated in FIG. 2 except that a straight tube 18 is provided in the casing hopper 3. FIG. 4B is an enlarged view of the straight tube 18. Since the straight tube 18 extends to the entrance 4, the repose angle of the particles (toner particles) can be reduced, thereby preventing adhesion of the particles to the pulverization/classification device and aggregation of the particles in the device.

As illustrated in FIG. 4B, the straight tube 18 also has a sintered wire mesh 18*a* serving as a fluidized bed. Similarly to the mesh 3*a*, the sintered wire mesh 18*a* has a structure such that plural different meshes are overlaid while united. The size of openings of the mesh 18*a* is not particularly limited, but is generally not greater than 3 μm, and preferably not greater than 2 μm. Referring to FIG. 4B, openings 18E are provided on the outer surface of the straight tube 18 to spout air for fluidizing the particles from the mesh 18*a*. The pressure of air supplied to the fluidized bed is preferably from 0.05 to 0.2 MPA so that a small amount of air is evenly spouted from the entire of the mesh 18*a*.

Figure 5A:
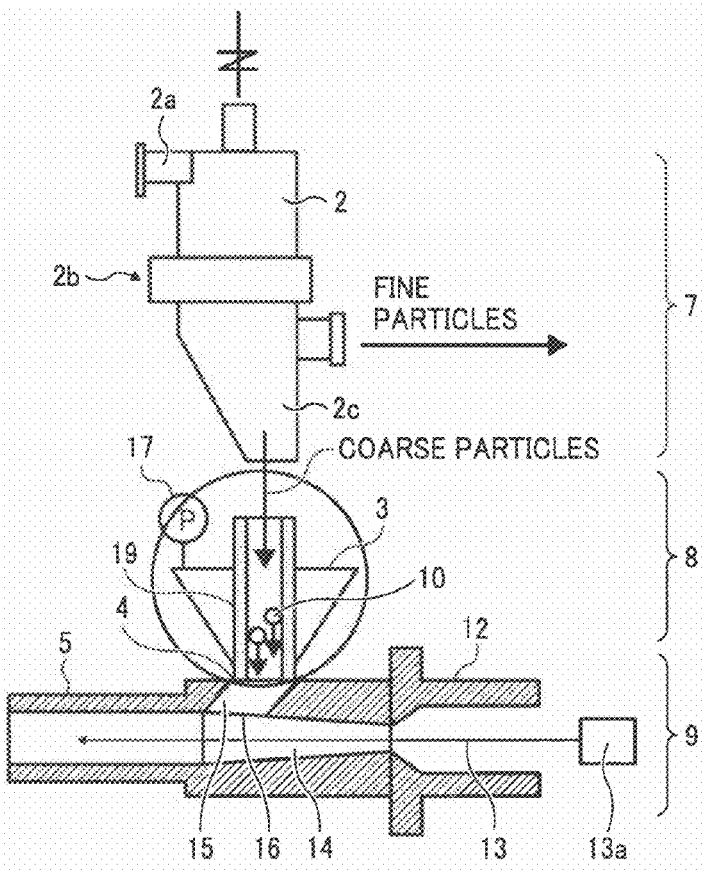
FIG. 5A is a schematic view illustrating a further example of the airflow pulverization/classification device of the present invention.
Figure 5B:
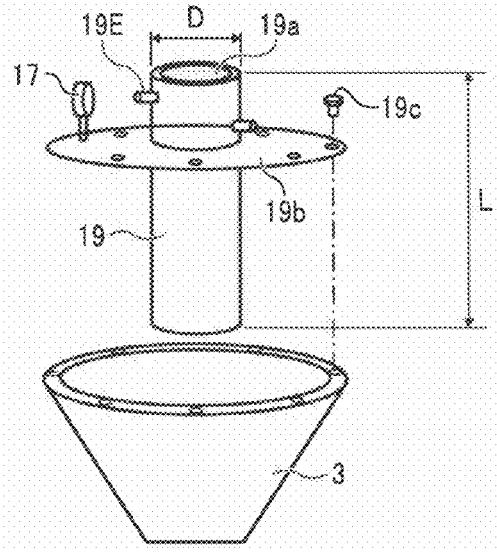
FIG. 5B is an enlarged view of a portion of the device illustrated in FIG. 5A.

FIG. 5A is a schematic view illustrating yet another example of the airflow pulverization/classification device of the present invention, which is the same as the device illustrated in FIG. 4 except that a straight tube 19 can be detachably attached to the casing hopper 3. FIG. 5B is an enlarged view of the casing hopper 3 and the straight tube 19 serving as a fluidized bed. The straight tube 19 is integrated with an upper cover 19*b*. The upper cover 19*b* is fixed to the upper surface of the casing hopper 3 with screws 19*c*. In this regard, diameter D and length L of the straight tube 19 (i.e., the ratio (L/D)) can be freely changed depending on the property of the particles to be pulverized influencing adhesion and aggregation of the particles. Similarly to the straight tube 18 illustrated in FIG. 4B, the straight tube 19 also has a mesh 19*a* and openings 19E.

In the airflow pulverization/classification device of the present invention, the weight average particle diameter of the particulate material to be pulverized is preferably not greater than 10 μm, and more preferably not greater than 6 μm.

In the above examples of the airflow pulverization/classification device of the present invention, the pressure gauge is provided on an upper portion of the casing hopper 3 to measure the static pressure in the hopper. However, the position of the pressure gauge is not limited thereto. The pressure gauge can be provided on the supply tube or at the junction of the acceleration tube with the supply tube to measure the static pressure therein.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed.

| | |
|---|---|
| Styrene - acrylic copolymer | 75 parts |
| Polyester resin | 10 parts |
| Carbon black | 15 parts |

The mixture was heated and kneaded with a roll mill, followed by cooling to solidify the kneaded mixture. The solidified toner constituent mixture was then crushed with a hammer mill. The crushed toner constituent mixture was then pulverized with the airflow pulverization/classification device illustrated in FIG. 3A to prepare toner particles.

In this pulverization/classification operation, the static pressure in the casing hopper 3 was controlled so as to be −10 kPa, and the crushed toner constituent mixture was supplied to the device at a feeding speed of 50 kg/h. As a result, toner particles having a weight average particle diameter of 7.35 μm, and including super-fine particles having a particle diameter of not greater than 4 μm in an amount of 56% by number could be stably prepared over 10 hours.

Thus, since it becomes possible to confirm the static pressure in the casing hopper, the pulverization conditions of the particulate material to be pulverized can be determined quantitatively, and thereby the pulverization operation can be stably performed. Namely, since the relationship between the pulverization conditions and the physical properties (such as particle diameter and particle diameter distribution) of the product can be determined, a product having desired properties can be stably produced at a proper pulverization/classification speed without causing a problem in that the particulate material to be pulverized is excessively supplied to the device.

Comparative Example 1

The procedure for preparation of the toner in Example 1 was repeated except that the pulverization/classification device illustrated in FIG. 1 was used. In this regard, the classification conditions were the same as those in Example 1. Therefore, toner particles having a weight average particle diameter of 7.35 μm, and including super-fine particles having a particle diameter of not greater than 4 μm in an amount of 56% by number were prepared at the beginning of the pulverization/classification operation. When this pulverization/classification operation was continued for 2 hours while supplying the crushed toner constituent mixture at a speed of 55 kg/h, the weight average particle diameter and the content of super-fine particles having a particle diameter of not greater than 4 μm were changed to 6.35 μm and 76% by number, respectively. In addition, since the pulverization chamber was clogged with the toner particles, the pulverization/classification operation was forced to stop.

Example 2

The procedure for preparation of the toner in Example 1 was repeated except that a sintered wire mesh having openings of not greater than 2 μm was arranged on the casing hopper to provide a fluidized bed. In addition, air was supplied to the casing hopper while controlling the pressure of air spouted from the openings of the mesh at 0.05 MPa, and in addition the static pressure in the casing hopper was controlled at −10 kPa. When the pulverization/classification operation was continued under those conditions while supplying the crushed toner constituent mixture at a feeding speed of 57 kg/h, toner particles having a weight average particle diameter of 7.35 μm, and including super-fine particles having a particle diameter of not greater than 4 μm in an amount of 56% by number could be stably prepared over 10 hours.

In this example, by forming a fluidized bed on the casing hopper, the amount of the particulate material (i.e., the crushed toner constituent mixture) causing adhesion and aggregation in the vicinity of the entrance (i.e., the entrance 4 in FIG. 3A) was reduced. Therefore, the particulate material could be stably supplied to the device, and thereby the static pressure in the pulverization chamber could be relatively stabilized compared to that in Example 1. Therefore, the properties of the resultant toner particles were stabilized and the processing capability of the device could be enhanced.

Example 3

The procedure for preparation of the toner in Example 1 was repeated except that a sintered wire mesh having openings of not greater than 2 μm was arranged on the casing hopper to provide a fluidized bed. In addition, air was supplied to the casing hopper while controlling the pressure of air spouted from the openings of the mesh at 0.05 MPa, and in addition the static pressure in the casing hopper was controlled in a range of from −7 kPa to −12 kPa. As a result, toner particles having a weight average particle diameter of 7.30 μm, and including super-fine particles having a particle diameter of not greater than 4 μm in an amount of 55% by number could be stably prepared over 10 hours when supplying the particulate material at a speed of 59 kg/h.

In this example, by controlling the static pressure in the casing hopper in a proper range, the amount of the particulate material fed to the pulverization chamber could be optimized, and thereby processing capability of the device could be enhanced while the properties of the resultant toner particles were maintained.

Example 4

The procedure for preparation of the toner in Example 1 was repeated except that the pulverization/classification device was changed to the device illustrated in FIG. 4A and a sintered wire mesh having openings of not greater than 2 μm was arranged on the inner surface of the straight tube 18 to provide a fluidized bed. In addition, air was supplied to the casing hopper while controlling the pressure of air spouted from the openings of the mesh at 0.05 MPa, and in addition the static pressure in the casing hopper was controlled in a range of from −7 kPa to −12 kPa. As a result, toner particles having a weight average particle diameter of 7.35 μm, and including super fine particles having a particle diameter of not greater than 4 μm in an amount of 55% by number could be stably prepared over 10 hours when supplying the particulate material at a speed of 61 kg/h.

In this example, since a straight tube having a fluidized bed was used as the hopper, the repose angle of the toner particles could be reduced, and thereby the amount of the particulate material adhered to the device can be reduced. Therefore, the amount of the particulate material fed to the device could be maximized. Thereby, processing capability of the device could be largely enhanced while the properties of the resultant toner particles were maintained.

Example 5

The procedure for preparation of the toner in Example 1 was repeated except that the pulverization/classification device was changed to the device illustrated in FIG. 5A (i.e., the straight tube is fixed to the hopper) and a sintered wire mesh having openings of not greater than 2 μm was arranged on the inner surface of the straight tube 18 to provide a fluidized bed. In addition, air was supplied to the casing hopper while controlling the pressure of air spouted from the openings of the mesh at 0.05 MPa, and in addition the static pressure in the casing hopper was controlled in a range of from −7 kPa to −12 kPa. As a result, toner particles having a weight average particle diameter of 7.35 μm, and including super-fine particles having a particle diameter of not greater than 4 μm in an amount of 55% by number could be stably prepared over 10 hours when supplying the particulate material at a speed of 61 kg/h.

In this example, since a straight tube having a fluidized bed was used as the hopper, the repose angle of the toner particles could be reduced, and thereby the amount of the particulate material adhered to the device can be reduced. Therefore, the amount of the particulate material fed to the device could be maximized. Thereby, processing capability of the device could be largely enhanced while the properties of the resultant toner particles were maintained. In addition, after the pulverization/classification operation, the straight tube could be easily detached from the device, the straight tube could be inspected and cleaned in a short time.

Thus, the device has good productivity (i.e., the cleaning time and down time between different toner manufacturing operations can be shortened and toner particles can be produced at a relatively high speed).

This document claims priority and contains subject matter related to Japanese Patent Application No. 2009-000113, filed on Jan. 5, 2009, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An airflow pulverization and classification device comprising:

a pulverizer configured to pulverize a particulate material, wherein the pulverizer includes:

a pulverization chamber including a collision member;

a jet nozzle configured to direct jet flow toward the pulverization chamber;

a feeder separate from the pulverization chamber and configured to feed the particulate material to a supply tube;

a supply nozzle having an acceleration tube connected with the jet nozzle at a first end thereof while connected with the pulverization chamber at a second end thereof, and the supply tube connected with the feeder at a first end thereof while connected with the acceleration tube at a second end thereof to supply the particulate material fed by the feeder to the acceleration tube so that the particulate material is collided with the collision member by the jet flow to be pulverized;

a pressure gauge provided on the feeder configured to measure at least one of a suction pressure in the feeder, a suction pressure in the supply tub; and a suction pressure at a junction of the acceleration tube and the supply tube, wherein supply conditions of the particulate material supplied to the acceleration tube are controlled on the basis of the measured suction pressure, a classifier configured to classify the pulverized particulate material.

2. The airflow pulverization and classification device according to claim 1, wherein the pulverizer further comprises:

wherein the feeder includes a fluidized bed located above the junction of the acceleration tube and the supply tube to supply the particulate material to be pulverized to the acceleration tube while fluidizing the particulate material.

3. The airflow pulverization and classification device according to claim 2, wherein the feeder includes a hopper configured to supply the particulate material to be pulverized to the first end of the supply tube.

4. The airflow pulverization and classification device according to claim 3, wherein the hopper is formed by a double structure, wherein the double structure comprises an inner wall of the hopper and a wire mesh provided above the inner wall of the hopper, the wire mesh providing the fluidized bed.

5. The airflow pulverization and classification device according to claim 4, wherein an outer surface of the hopper is provided with openings to spout air from the wire mesh.

6. The airflow pulverization and classification device according to claim 1, wherein an amount of the particulate material supplied to the acceleration tube is controlled so that the suction pressure falls in a range of from −3 kPa to −15 kPa.

7. The airflow pulverization and classification device according to claim 1, wherein the feeder includes a hopper configured to supply the particulate material to be pulverized to the first end of the supply tube, wherein the hopper includes a straight tube extending to the first end of the supply tube.

8. The airflow pulverization and classification device according to claim 7, wherein the straight tube is an adapter tube, which can be detachably attachable to the pulverizer and which can change a ratio (L/D) of a length (L) to a diameter (D) thereof.

9. The airflow pulverization and classification device according to claim 7, wherein the straight tube comprises an inner wall and a fluidized bed provided radially inward of the inner wall.

10. The airflow pulverization and classification device according to claim 9, further comprising: a cover disposed on an upper surface of the hopper, wherein the cover is integrated with the straight tube.

11. The airflow pulverization and classification device according to claim 9, wherein an outer surface of the straight tube is provided with openings to spout air from the fluidized bed.

12. The airflow pulverization and classification device according to claim 11, further comprising: a cover disposed on an upper surface of the hopper, wherein the cover is integrated with the straight tube.

13. The airflow pulverization and classification device according to claim 12, wherein the openings are disposed along the outer surface of the straight tube above the cover.

14. The airflow pulverization and classification device according to claim 1, wherein the particulate material to be pulverized has a weight average particle diameter of not greater than 10 μm.

15. The airflow pulverization and classification device according to claim 1, further comprising: an airflow source configured to form the jet flow at a pressure of from 0.4 MPa to 0.7 MPa.

16. The airflow pulverization and classification device according to claim 1, wherein the feeder includes a hopper configured to supply the particulate material to be pulverized to the first end of the supply tube.

17. The airflow pulverization and classification device according to claim 16, wherein the hopper is formed by a double structure, wherein the double structure comprises an inner wall of the hopper and a fluidized bed provided above the inner wall of the hopper.

18. The airflow pulverization and classification device according to claim 17, wherein an outer surface of the hopper is provided with openings to spout air from the fluidized bed.

* * * * *